US009926501B2

(12) United States Patent
Yows et al.

(10) Patent No.: US 9,926,501 B2
(45) Date of Patent: Mar. 27, 2018

(54) ENTRAINED-FLOW GASIFIER AND METHOD FOR REMOVING MOLTEN SLAG

(71) Applicant: GAS TECHNOLOGY INSTITUTE, Des Plaines, IL (US)

(72) Inventors: Stephen Arthur Yows, Sacramento, CA (US); Steven P. Fusselman, Sacramento, CA (US)

(73) Assignee: Gas Technology Institute, Des Plaines, IL (US)

( * ) Notice: Subject to any disclaimer, the term of this patent is extended or adjusted under 35 U.S.C. 154(b) by 174 days.

(21) Appl. No.: 14/898,262

(22) PCT Filed: Jun. 2, 2014

(86) PCT No.: PCT/US2014/040458
§ 371 (c)(1),
(2) Date: Dec. 14, 2015

(87) PCT Pub. No.: WO2014/200744
PCT Pub. Date: Dec. 18, 2014

(65) Prior Publication Data

US 2016/0137935 A1 May 19, 2016

Related U.S. Application Data

(60) Provisional application No. 61/834,072, filed on Jun. 12, 2013.

(51) Int. Cl.
*C10J 3/48* (2006.01)
*C10J 3/46* (2006.01)
(Continued)

(52) U.S. Cl.
CPC ..... *C10J 3/485* (2013.01); *C10J 3/08* (2013.01); *C10J 3/466* (2013.01); *C10J 3/76* (2013.01); *C10J 2300/0956* (2013.01); *C10J 2300/0976* (2013.01); *C10J 2300/1884* (2013.01); *C10J 2300/1892* (2013.01)

(58) Field of Classification Search
CPC combination set(s) only.
See application file for complete search history.

(56) References Cited

U.S. PATENT DOCUMENTS 2,701,755 A * 2/1955 Strasser ..... C03B 5/26 137/1
2,931,715 A * 4/1960 Eastman ..... C10J 3/485 48/206

(Continued)

FOREIGN PATENT DOCUMENTS

| | | |
|---|---|---|
| EP | 1 956 327 A1 | 8/2008 |
| EP | 2 447 341 A1 | 5/2012 |
| WO | WO 94/16038 | 7/1994 |

*Primary Examiner* — Kaity V Chandler
(74) *Attorney, Agent, or Firm* — Pauley Erickson & Kottis

(57) ABSTRACT

An entrained-flow gasifier reactor includes a vessel and a first liner within the vessel. The first liner extends around a reaction zone in the vessel and has an inlet end and an exit end with respect to the reaction zone. The first liner includes a drip lip at the exit end. An isolator is arranged near the drip lip. The isolator is operable to thermally isolate the drip lip from a quench zone downstream from the reaction zone such that molten slag at the drip lip remains molten.

21 Claims, 6 Drawing Sheets

(51) Int. Cl.
*C10J 3/08* (2006.01)
*C10J 3/76* (2006.01)

(56) References Cited

U.S. PATENT DOCUMENTS 2,961,310 A * 11/1960 Steever ..... C10J 3/20 48/206
4,272,255 A * 6/1981 Coates ..... C10J 3/485 122/5
4,326,856 A * 4/1982 Muenger ..... B01D 45/08 252/373
4,328,006 A * 5/1982 Muenger ..... B01D 45/08 122/5
4,368,103 A * 1/1983 Weinzierl ..... C10J 3/466 202/106
4,377,394 A * 3/1983 Muenger ..... B01D 45/08 122/5
4,436,530 A * 3/1984 Child ..... C10J 3/466 252/373
4,437,864 A * 3/1984 Gorris ..... C10J 3/00 122/5
4,704,137 A * 11/1987 Richter ..... C10J 3/06 252/373
4,818,253 A * 4/1989 Kohnen ..... C10J 3/485 122/235.12
4,850,001 A * 7/1989 Duysings ..... G01N 23/12 250/356.1
5,248,316 A * 9/1993 Peise ..... C01B 3/22 122/6 A
6,283,048 B1 * 9/2001 Fujinami ..... C10J 3/482 110/210
8,236,071 B2 * 8/2012 Corry ..... C10J 3/06 122/30
9,028,569 B2 * 5/2015 Tiwari ..... C10J 3/84 48/119
9,051,522 B2 * 6/2015 Jancker ..... C10J 3/485
9,096,808 B2 * 8/2015 Kuske ..... C10J 3/526
2003/0010267 A1 * 1/2003 Tischer ..... C10J 3/26 110/229
2005/0132647 A1 * 6/2005 Groen ..... C10J 3/485 48/101
2007/0272129 A1 * 11/2007 Schilder ..... C10J 3/485 110/171
2010/0031570 A1 * 2/2010 Chen ..... C10J 3/526 48/87
2010/0263278 A1 * 10/2010 Kowoll ..... C10J 3/485 48/67
2011/0010992 A1 * 1/2011 Kowoll ..... B01J 8/003 48/62 R
2011/0023362 A1 * 2/2011 Kirchhubel ..... C10J 3/485 48/71
2011/0162277 A1 * 7/2011 Russell ..... C10J 3/72 48/77
2012/0102835 A1 * 5/2012 Corry ..... C10J 3/485 48/87
2012/0110906 A1 * 5/2012 Kuske ..... C10J 3/485 48/87
2012/0110907 A1 * 5/2012 Kuske ..... C10J 3/485 48/87
2012/0189499 A1 * 7/2012 Kuske ..... C10J 3/485 422/119
2014/0014186 A1 * 1/2014 Bhattacharya ..... C10J 3/845 137/1
2014/0048744 A1 * 2/2014 Avagliano ..... C10K 1/04 252/372
2014/0090296 A1 * 4/2014 Talcott ..... C10K 1/04 48/61
2015/0075072 A1 * 3/2015 Hannemann ..... C10K 1/02 48/128

* cited by examiner

ENTRAINED-FLOW GASIFIER AND METHOD FOR REMOVING MOLTEN SLAG

CROSS-REFERENCE TO RELATED APPLICATION

The present disclosure claims benefit to Provisional Application Ser. No. 61/834,072, filed on Jun. 12, 2013.

BACKGROUND

This disclosure relates to reactor vessels that produce molten byproducts.

Carbonaceous fuel gasifiers are used to react oxygen, steam and carbonaceous material to produce a gaseous reaction product of synthesis gas (predominantly carbon monoxide and hydrogen). The reaction also produces a slag byproduct from inert constituents in the carbonaceous fuel. The slag is typically discharged from the reactor with the gaseous reaction products.

SUMMARY

An entrained-flow gasifier reactor according to an example of the present disclosure includes a vessel and a first liner within the vessel. The first liner extends around a reaction zone in the vessel and has an inlet end and an exit end with respect to the reaction zone. A drip lip is located at the exit end of the first liner, and an isolator is arranged near the drip lip. The isolator is operable to thermally isolate the drip lip from a quench zone downstream of the reaction zone such that molten slag at the drip lip remains molten.

In a further embodiment of any of the foregoing embodiments, the isolator diverges from the exit end of the first liner.

In a further embodiment of any of the foregoing embodiments, the isolator is an internally-cooled liner.

In a further embodiment of any of the foregoing embodiments, the isolator extends circumferentially around the drip lip.

In a further embodiment of any of the foregoing embodiments, there is a radial gap between the isolator and the drip lip.

A further embodiment of any of the foregoing embodiments includes a second liner arranged downstream from the first liner, the second liner extending around the quench zone in the vessel.

In a further embodiment of any of the foregoing embodiments, the first liner and the second liner are each internally cooled.

In a further embodiment of any of the foregoing embodiments, the first liner has a maximum diameter and the second liner has a minimum diameter that is greater than the maximum diameter.

In a further embodiment of any of the foregoing embodiments, the vessel includes quench nozzles arranged axially beneath the isolator with respect to a longitudinal axis of the vessel.

In a further embodiment of any of the foregoing embodiments, the reaction zone has a constant cross-sectional area along a longitudinal axis of the vessel.

In a further embodiment of any of the foregoing embodiments, the drip lip includes a vertical inside surface facing the reaction zone, an opposed vertical outside surface and an axial end surface, with respect to a longitudinal axis of the vessel, and the axial end surface includes a retrograde portion.

In a further embodiment of any of the foregoing embodiments, the first liner is radially spaced from the vessel to provide a gap there between, and including an annular baffle extending between the vessel and the first liner, the annular baffle operable to direct gas flow from the gap between the first liner and the vessel into a radial gap between the isolator and the first liner.

An entrained-flow gasifier reactor according to an example of the present disclosure includes an elongated vessel that has a top end and a bottom end. The elongated vessel is operable in a vertical orientation and has an injector at the top end. A first internally-cooled liner is located within the elongated vessel. The first internally-cooled liner extends around a reaction zone in the elongated vessel and has an inlet end and an exit end with respect to the reaction zone. A drip lip is at the exit end of the first internally-cooled liner. A slag collector is located below the drip lip, and there is an isolator arranged about the drip lip. The isolator is operable to thermally isolate the drip lip from a quench zone downstream of the reaction zone such that molten slag at the drip lip remains molten.

A further embodiment of any of the foregoing embodiments includes a second internally-cooled liner arranged within the elongated vessel downstream from the first internally-cooled liner, the second internally-cooled liner extending around the quench zone in the elongated vessel, and the isolator is a third internally-cooled liner.

In a further embodiment of any of the foregoing embodiments, the first internally-cooled liner, the second internally-cooled liner and the third internally-cooled are on separate cooling circuits from each other.

In a further embodiment of any of the foregoing embodiments, the elongated vessel includes vessel outlets at and near the bottom end discharging slag and product gas, respectively.

In a further embodiment of any of the foregoing embodiments, the isolator diverges from the exit end of the first internally-cooled liner.

A method for managing molten slag in an entrained-flow gasifier reactor according to an example of the present disclosure includes introducing reactants into a reaction zone in a vessel. The reactants react and produce a gaseous reaction product and molten slag. The molten slag is removed from the reaction zone by allowing the molten slag to flow off of a drip lip and free fall through a cooled quench zone and into a slag collector. The cooled quench zone is at a lower temperature than the reaction zone. The drip lip is thermally isolated from the cooled quench zone such that that the molten slag at the drip lip remains molten.

In a further embodiment of any of the foregoing embodiments, at least one of the reactants is solid, carbonaceous material.

A further embodiment of any of the foregoing embodiments includes maintaining the environment around the drip lip at a temperature of greater than 1500° F. (815° C.).

In a further embodiment of any of the foregoing embodiments, the thermal isolating of the drip lip includes using an internally-cooled liner arranged around the drip lip.

The method as recited in claim 18, further comprising injecting a gas curtain around the drip lip to limit deposit of molten slag as it free falls from the drip lip.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
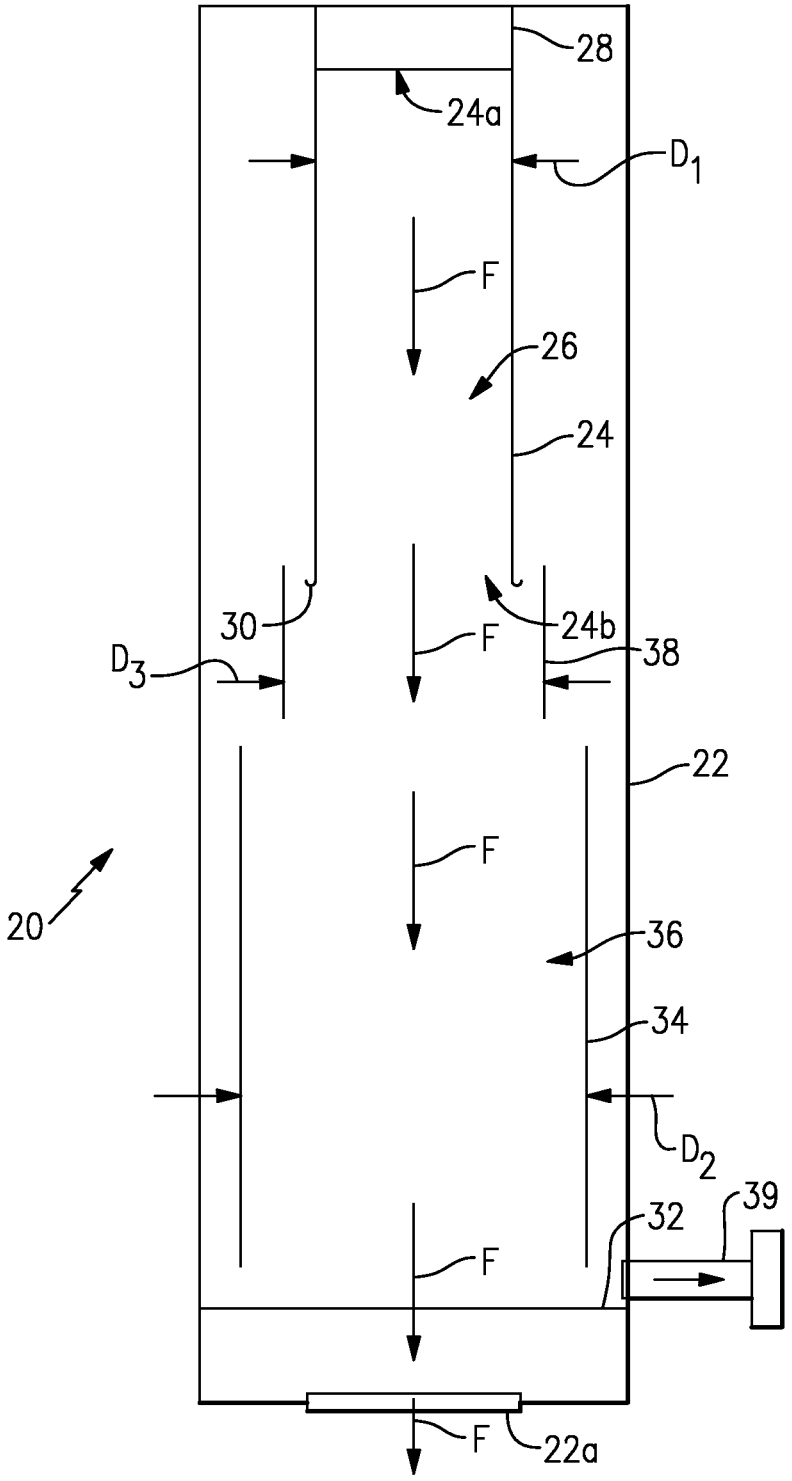
FIG. 1 illustrates an example entrained-flow gasifier reactor.

FIG. 1 illustrates an entrained-flow gasifier reactor 20 (hereafter "reactor 20"). As will be appreciated from this disclosure, the reactor 20 is operable to react oxygen, steam and carbonaceous materials to form synthesis gas, which typically includes carbon monoxide and hydrogen. Although the examples may be presented in the context of carbonaceous fuel gasification, it is to be understood that this disclosure can also be applied to other types of entrained-flow reactors that produce a slag byproduct. As used herein to describe reactors, the term "entrained-flow" refers to a reactor that is adapted to receive a reactant input that includes a solid, usually particulate material, entrained in a carrier gas (e.g., nitrogen, carbon dioxide, etc.) and manage slag that is produced by the reaction of the solid material. The term "slag" refers to a solid or liquid byproduct of a reaction, which, if unmanaged, can build-up in a reactor. The reactor 20 is thus adapted for vertical operation to facilitate gravimetric slag removal. As will be described in further detail, the reactor 20 includes features for enhanced management of molten slag. For instance, if molten slag is not properly managed, it can deposit and solidify on internal components of a reactor and, over time, require maintenance that can reduce durability and increase costs.

Referring to FIG. 1, the reactor 20 is shown schematically for purposes of description. It is to be understood, however, that the reactor 20 can include additional components that are excluded from the illustrated view, such as but not limited to controllers, valves, ports, gauges, sensors, etc. The reactor 20 includes a vessel 22 and a first liner 24 within the vessel 22. The first liner 24 generally extends around a reaction zone 26 into which reactants are injected to react and produce gaseous reaction products and molten slag. For example, the first liner 24 can be tubular such that the reaction zone 26 is cylindrical and has a constant cross-section along the longitudinal axis A of the vessel 22, although the cross-section can alternatively converge. The first liner 24 includes, with respect to the reaction zone 26, an inlet end 24*a* and an exit end 24*b*. In this example, the reactor 20 includes an injector 28 at the top end of the vessel 22 near the inlet end 24*a* for introducing the reactants into the reaction zone 26. An igniter can also be included.

A drip lip 30 is located at the exit end 24*b* of the first liner 24, the function of which will be described in further detail below. For example, in simple form, the drip lip 30 is an area from which molten slag drips into a free fall through the vessel 22. In this regard, the drip lip 30 can simply be the terminal end of the first liner 24 where the inside surface of the first liner 24 turns outwards and upwards (relative to flow through the vessel 22, represented at F). As also described in further examples below (e.g., see FIGS. 4 and 6), the drip lip 30 can also be designed with a geometry that further facilitates detachment of molten slag to serve the drip functionality. The drip lip 30 can be a part of the first liner 24 or can be a separate component from the first liner 24. A slag collector 32 is located below the drip lip 30. The slag collector 32 can include a pool of water or other cooling bed adapted for receiving and solidifying the slag. A second liner 34 is arranged downstream from the first liner 24 with respect to the flow through the vessel 22. The second liner 34 generally extends around a quench zone 36 in the vessel 22. An isolator 38 is arranged near, and extends around, the drip lip 30. The isolator 38 is operable to thermally isolate the drip lip 30 from the quench zone 36 such that molten slag at the drip lip 30 remains molten.

Reactants are introduced through the injector 28 into the reaction zone 26. The reactants react at elevated temperatures, typically above 1500° F. (815° C.) and nominally in a range of 2200-3500° F. (1204-1927° C.), to produce product gas and molten slag. The product gas is discharged from an outlet 39 near the bottom of the vessel 22. The molten slag deposits on the inside surfaces of the first liner 24. The vessel 22 is vertically oriented and the molten slag thus gravitationally flows downwards toward the drip lip 30. The molten slag then drops off of the drip lip 30 and free falls downwards into the slag collector 32. The vessel 22 and its components are arranged such that the molten slag reliably drops without contacting any components prior to falling into the slag collector 32. Otherwise, the slag may build-up in the vessel 22. As an example, as depicted in FIG. 1, the first liner 24 has a maximum diameter $D_1$ and the second liner 34 has a minimum diameter $D_2$ that is greater than the maximum diameter $D_1$ so that contact between the dropping slag and second liner 34 is avoided. Likewise, the isolator 38 can have a minimum diameter D2, which is also greater than the maximum diameter $D_1$ to avoid contact with the dropping slag.

The molten slag that drops from the drip lip 30 falls through the quench zone 36. The quench zone 36 is at a lower temperature than the reaction zone 26 to cool the byproduct gas before it exits through an outlet 22*a* at the bottom end of the vessel 22. The relatively cooler temperatures in the quench zone 36 coupled with the proximity of the quench zone 36 to the reaction zone 24 can, if not managed, cool the exit end 24*b* of the first liner 24 to temperatures that can cause the molten slag to stick (e.g., partially or fully solidify the slag) to the first liner 24 rather than flow and drop off of the drip lip 30. The isolator 38 serves to thermally isolate the drip lip 30 from the cooler temperatures of the quench zone 36 such that the molten slag at the drip lip 30 remains molten and can thus drop from the drip lip 30 into the slag collector 32.

Figure 2:
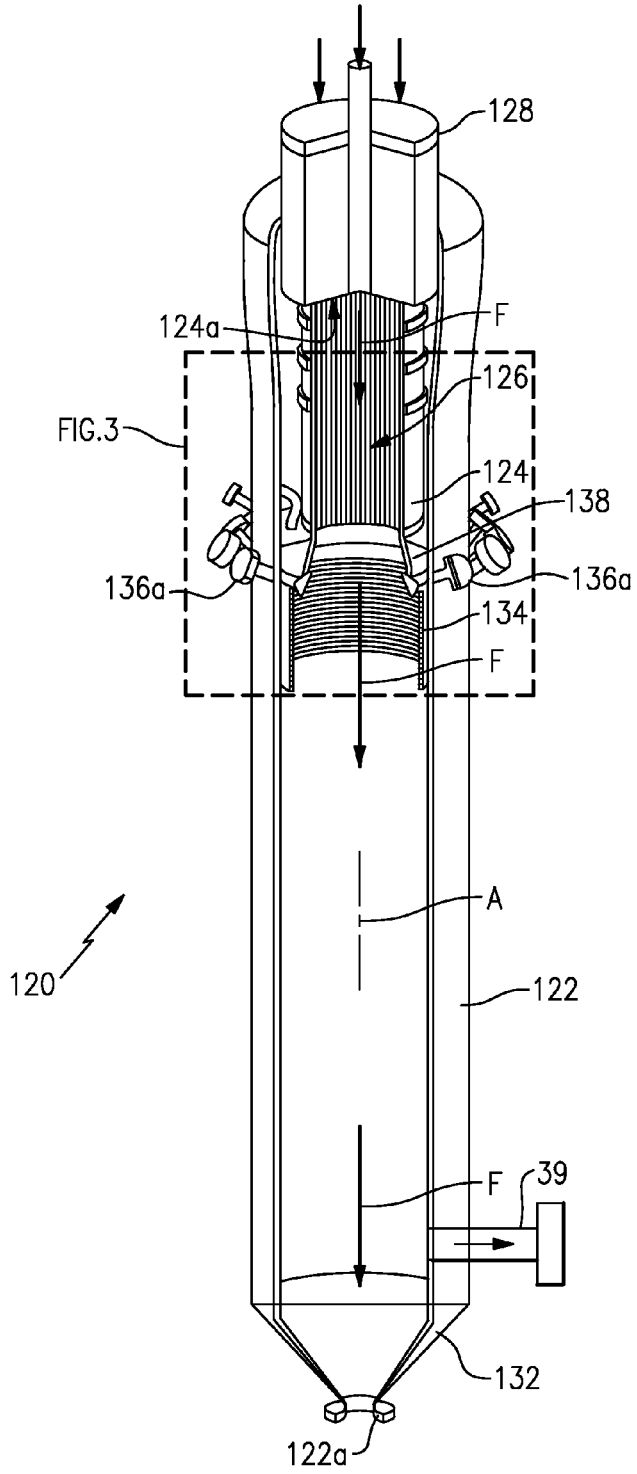
FIG. 2 illustrates another example entrained-flow gasifier reactor.
Figure 3:
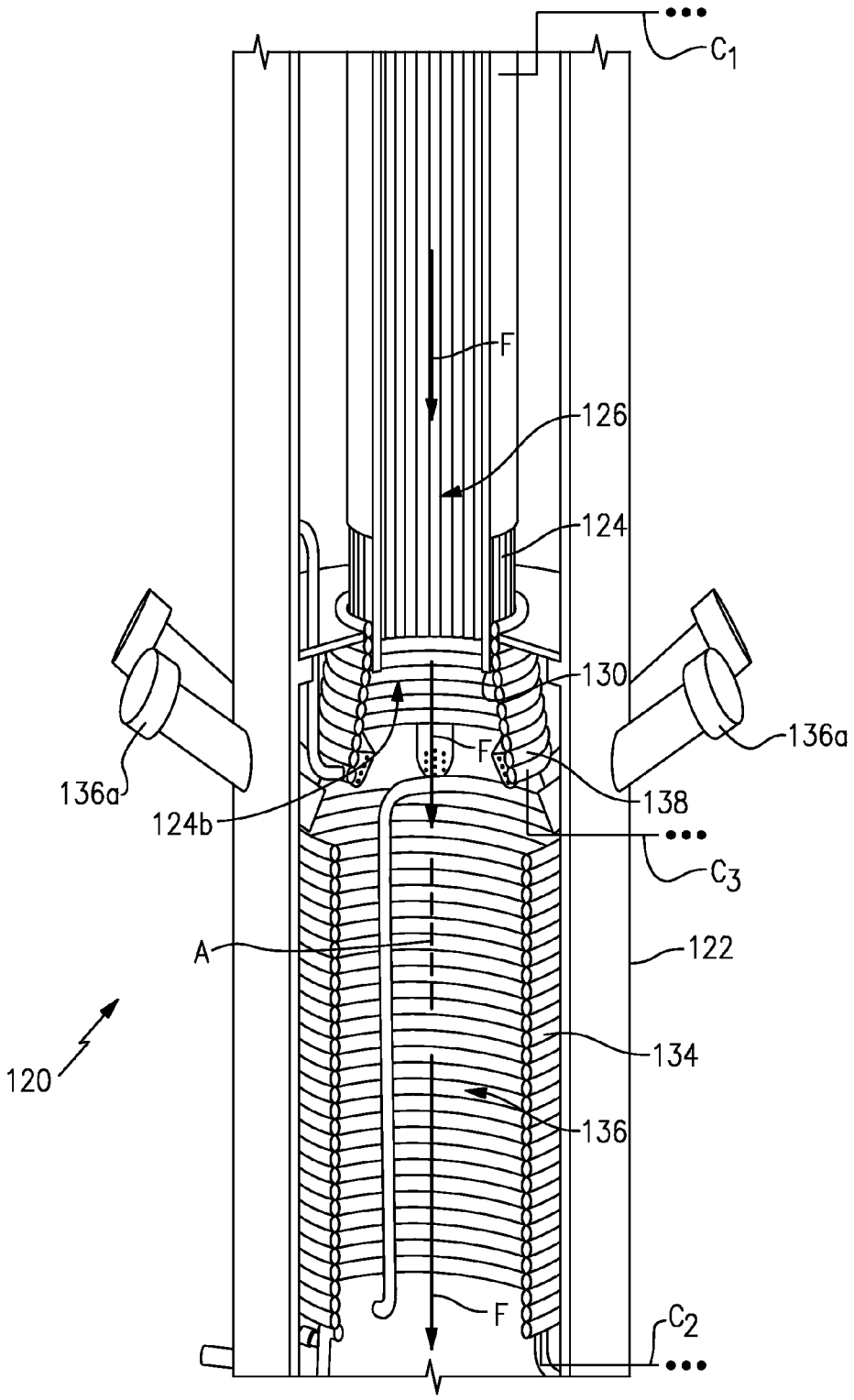
FIG. 3 illustrates a portion of an entrained-flow gasifier reactor according to the section shown in FIG. 2.

FIG. 2 illustrates another example entrained-flow gasifier reactor 120 (hereafter "reactor 120"), and FIG. 3 shows a portion of the reactor 120 according to the section shown in FIG. 2. In this disclosure, like reference numerals designate like elements where appropriate and reference numerals with the addition of one-hundred or multiples thereof designate modified elements that are understood to incorporate the same features and benefits of the corresponding elements. Similar to the reactor 20, the reactor 120 includes a vessel 122, a first liner 124 within the vessel 122 and extending around a reaction zone 126. The first liner 124 has an inlet end 124*a* and an exit end 124*b* with respect to the reaction zone 126. The first liner 124 also has a drip lip 130 at the exit end 124*b*. A slag collector 132 is located below the drip lip 130, and a vessel outlet 122*a* at the bottom end of the vessel 122 for discharging slag. A second liner 134 is arranged downstream from the first liner 124. The second liner 134 extends around a quench zone 136 in the vessel 122.

An isolator 138 is arranged near the drip lip 130 and extends circumferentially around the drip lip 130. Quench nozzles 136*a* are circumferentially spaced around the vessel 122 axially between the second liner 134 and the isolator 138. The quench nozzles 136*a* are adapted to permit injection or spraying of a cooling fluid, such as water, into the quench zone 136. For example, sufficient water is injected to cool the product stream to a temperature range of 500-1500° F. (260-815° C.), which avoids saturating the product stream with water but cools the slag below its "sticking" temperature. Similar to isolator 38, the isolator 138 is also operable to thermally isolate the drip lip 130 from the quench zone 136 such that molten slag at the drip lip 130 remains molten.

In this example, each of the first liner 124 and the second liner 134 are internally-cooled liners and are on separate cooling circuits, represented at $C_1$ and $C_2$. The liners 124/134 circulate cooling fluids, such as water, through internal passages on the separate circuits $C_1$ and $C_2$ such that the cooling fluid flows through the first liner 124 exclusive of the cooling fluid flowing through the second liner 134, and vice versa. Thus, the reaction zone 126 and the quench zone 136 can be maintained at different temperatures.

In this example, the isolator 138 is also an internally-cooled liner, i.e., a third internally cooled liner. The internally-cooled liner of the isolator 138 is on a cooling circuit, $C_3$, which is separate from cooling circuits $C_1$ and $C_2$. In further examples, the isolator 138 can alternatively be on a cooling circuit that is integral with either of the cooling circuits $C_1$ or $C_2$. As used herein, the term "internally-cooled liner" refers to a structure that has internal fluid passages, such as a tubular structure. In the illustrated example, the first liner 124 includes vertically-oriented tubes, and the second liner 134 and isolator 138 include, respectively, helical, horizontally-oriented tubes. The tubes of the isolator 138 helically wrap around the exit end 124*b* of the first liner 124. The option to separate cooling circuit $C_3$ enables the isolator 138 to independently maintain the drip lip 130 at a desirable temperature, exclusive of the temperature control of the reaction zone 126 and the quench zone 136 provided by the cooling circuits $C_1$ and $C_2$, respectively. For gasification of carbonaceous fuel with steam and oxygen, the produced slag remains molten above 1500° F. (815° C.).

The isolator 138 diverges from the exit end 124*b* of the first liner 124. For example, the isolator 138 diverges at a half angle, with respect to a longitudinal axis A of the vessel 122, of 10° or greater. The divergence of the isolator 138 facilitates reducing or eliminating the deposit of slag on the inside walls of the isolator 138 due to deposition of fine slag on surfaces during expansion of the gas exiting the liner. In other words, as the molten slag drops off of the drip lip 130 and free falls toward the slag collector 132, the divergence of the isolator 138 avoids contact with the falling molten slag. Alternatively, the isolator 138 could be cylindrical and have a larger diameter than the first liner 124 to avoid contact with the molten slag.

Figure 4:
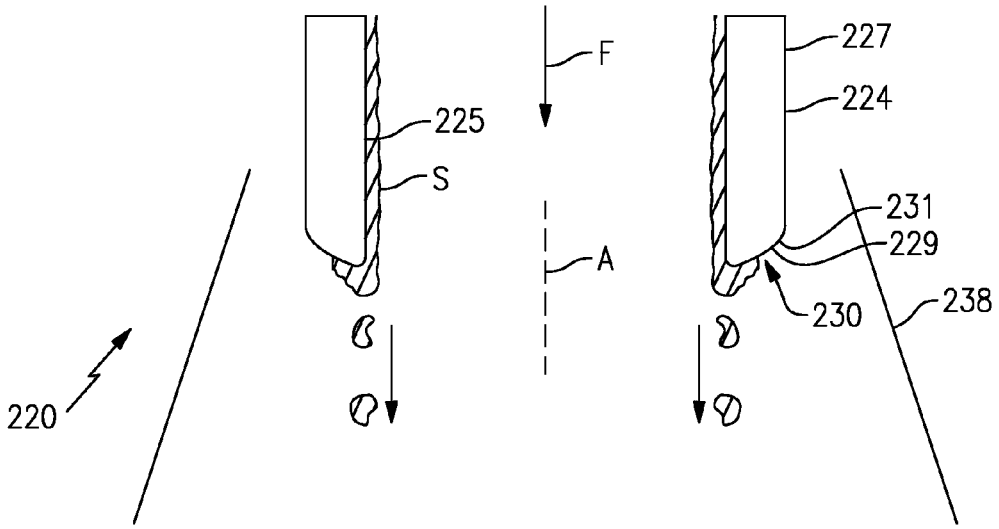
FIG. 4 illustrates an example drip lip having a retrograde portion.

FIG. 4 schematically illustrates a portion of another example entrained-flow gasifier reactor 220. In this example, portions of a first liner 224 and an isolator 238 are shown. The remaining portions can be similar to the prior examples. The first liner 224 includes vertical inside surfaces 225, opposed vertical outside surfaces 227 and an axial end surface 229 (with respect to a longitudinal axis A of the vessel) that includes the drip lip 230. The drip lip 230 of the axial end surface 229 includes a retrograde portion 231 that slants upwardly from the vertical inside surface 225 to the vertical outside surface 227.

Molten slag, represented at S, can deposit on the vertical inside surfaces 225. As the molten slag flows to and around the drip lip 230, the retrograde portion 231 precludes the molten slag from flowing upwardly and radially outwardly toward the isolator 238. This ensures that the molten slag drops from the drip lip 230 rather than flowing to, and depositing on, the inside surfaces of the isolator 238.

Figure 5:
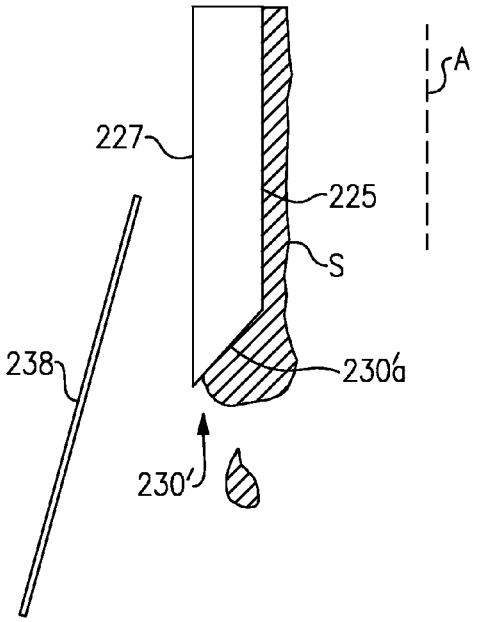
FIG. 5 illustrates another example drip lip.
Figure 6:
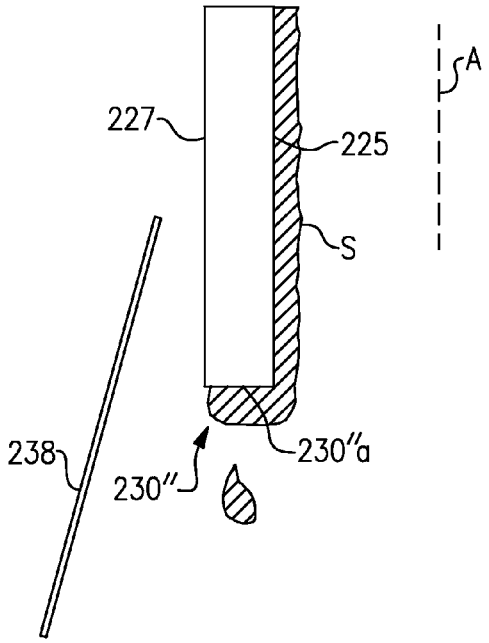
FIG. 6 illustrates another example drip lip.

FIGS. 5 and 6 show, respectively, alternate geometry drip lips 230'/230". It is to be understood that the drip lips 230'/230" are symmetric about axis A. The drip lip 230' includes frustoconical surface 230'a that slopes from inside surface 225 to outside surface 227. The drip lip 230" includes axial end 230"a that is "squared-off" with respect to the inside surface 225 and the outside surface 227.

Figure 7:
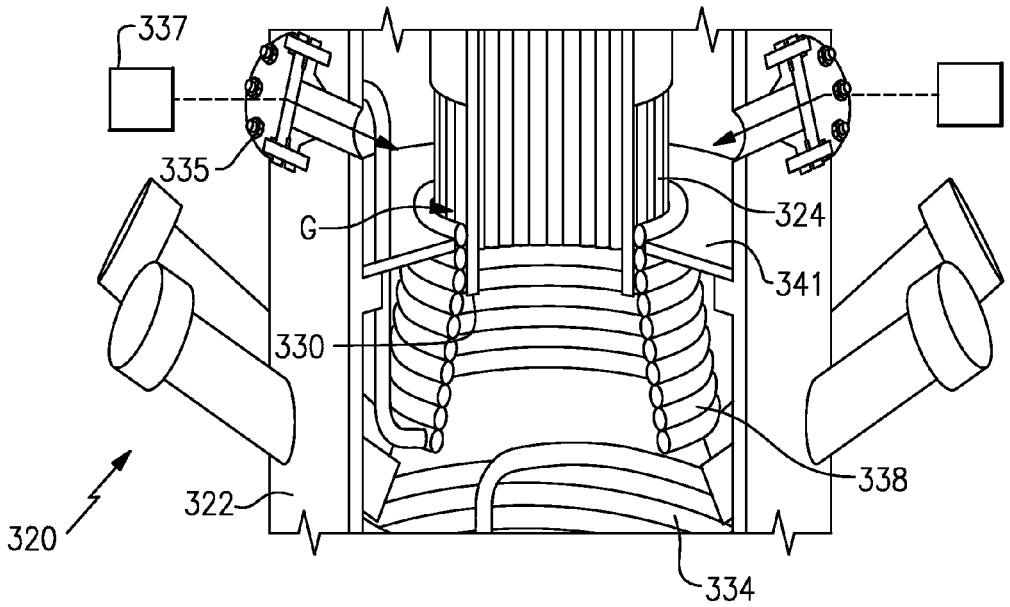
FIG. 7 illustrates another example entrained-flow gasifier reactor having a radial gap between a first liner and an isolator.
Figure 8:
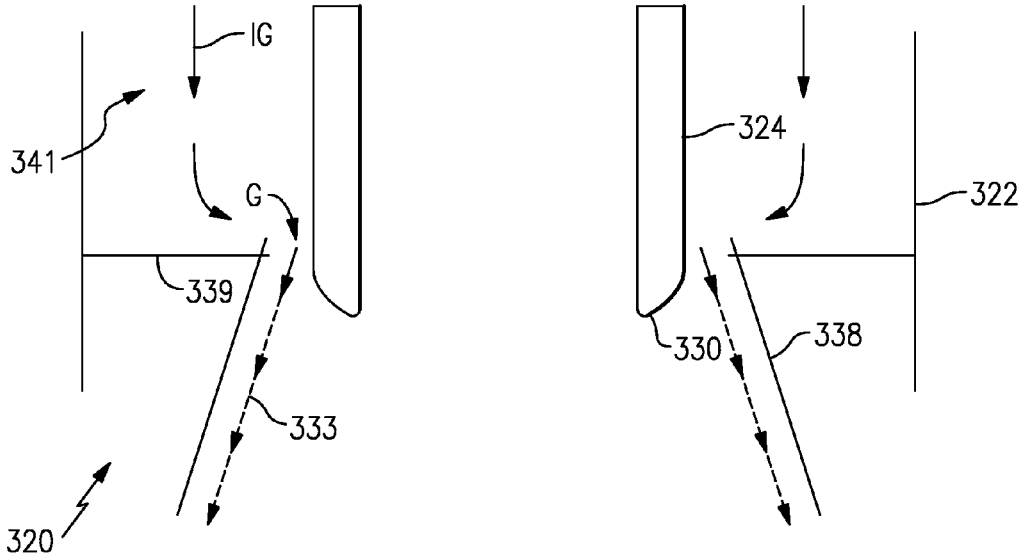
FIG. 8 illustrates the entrained-flow gasifier reactor of FIG. 5 schematically.

FIG. 7 illustrates another example entrained-flow gasifier reactor 320, which is also schematically represented in FIG. 8. In this example, there is a radial gap, G, between the first liner 324 and the isolator 338. The radial gap G serves to allow injection of gas down the sides of the isolator 338 to form a gas curtain 333 to protect the isolator 338 from coming into contact with molten slag that drops from the drip lip 330 or from impact by fine molten slag entrained in the gas exiting the liner. For example, the gas can be externally-supplied steam, carbon dioxide, nitrogen, synthesis gas (primarily carbon monoxide and hydrogen) or mixtures thereof. To this end, the vessel 322 can include nozzles 335 for connection with a gas source 337 to deliver the gas to the vessel 322. An annular baffle 339 is also provided between the vessel 322 and the isolator 338. The gas is injected through the nozzle 335 into a space or gap 341 between the first liner 324 and the vessel 322. The annular baffle 339 serves to direct the flow of the gas, IG, into the gap G and down the sides of the isolator 338 to form the gas curtain 333.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An entrained-flow gasifier reactor comprising:

a vessel;

a first liner within the vessel, the first liner extending around a reaction zone in the vessel, wherein the first liner has an inlet end and an exit end with respect to the reaction zone;

a drip lip at the exit end of the first liner, wherein the reaction zone has a constant cross-sectional area along a longitudinal axis of the vessel between the inlet end and an axial end surface of the drip lip;

an isolator arranged near the drip lip, the isolator operable to thermally isolate the drip lip from a quench zone downstream of the reaction zone such that molten slag at the drip lip remains molten.

2. The entrained-flow gasifier reactor as recited in claim 1, wherein the isolator diverges outward from the exit end of the first liner and the end surface of the drip lip.

3. The entrained-flow gasifier reactor as recited in claim 1, wherein the isolator is an internally-cooled liner.

4. The entrained-flow gasifier reactor as recited in claim 1, wherein the isolator extends circumferentially around the drip lip.

5. The entrained-flow gasifier reactor as recited in claim 4, wherein there is a radial gap between the isolator and the drip lip.

6. The entrained-flow gasifier reactor as recited in claim 1, further comprising a second liner arranged downstream from the first liner, the second liner extending around the quench zone in the vessel.

7. The entrained-flow gasifier reactor as recited in claim 6, wherein the first liner and the second liner are each internally cooled.

8. The entrained-flow gasifier reactor as recited in claim 6, wherein the first liner has a maximum diameter and the second liner has a minimum diameter that is greater than the maximum diameter.

9. The entrained-flow gasifier reactor as recited in claim 1, wherein the vessel includes quench nozzles arranged axially beneath the isolator with respect to a longitudinal axis of the vessel.

10. The entrained-flow gasifier reactor as recited in claim 1, wherein the drip lip includes a vertical inside surface facing the reaction zone, an opposed vertical outside surface and the axial end surface, with respect to a longitudinal axis of the vessel, and the axial end surface includes a retrograde portion.

11. An entrained-flow gasifier reactor comprising:

a vessel;

a first liner within the vessel, the first liner extending around a reaction zone in the vessel, wherein the liner has an inlet end and an exit end with respect to the reaction zone:

a drip lip at the exit end of the first liner;

an isolator arranged near the drip lip, the isolator operable to thermally isolate the drip lip from a quench zone downstream of the reaction zone such that molten slag at the drip lip remains molten, wherein the first liner is radially spaced from the vessel to provide a gap there between, and including an annular baffle extending between the vessel and the first liner, the annular baffle operable to direct gas flow from the gap between the first liner and the vessel into a radial gap between the isolator and the first liner.

12. An entrained-flow gasifier reactor comprising:

an elongated vessel including a top end and a bottom end, the elongated vessel operable in a vertical orientation and having an injector at the top end;

a first internally-cooled liner within the elongated vessel, the first internally-cooled liner extending around a reaction zone in the elongated vessel, a drip lip at the exit end of the first internally-cooled liner; wherein the first internally-cooled liner has an inlet end and an exit end with respect to the reaction zone; wherein the reaction zone and an inside surface of the drip lip have an equal constant cross-sectional area along a longitudinal axis of the vessel between the inlet end and an end surface of the drip lip; a slag collector located below the drip lip; and an isolator arranged about the drip lip, the isolator operable to thermally isolate the drip lip from a quench zone downstream of the reaction zone such that molten slag at the drip lip remains molten, wherein the isolator diverges outward from the exit end and the drip lip of the first internally-cooled liner.

13. The entrained-flow gasifier reactor as recited in claim 1, wherein the isolator comprises a helical, horizontally-oriented tube wrapped around the exit end or the drip lip.

14. The entrained-flow gasifier reactor as recited in claim 1, wherein the first liner comprises a vertically-oriented tube.

15. The entrained-flow gasifier reactor as recited in claim 12, further comprising a second internally-cooled liner arranged within the elongated vessel downstream from the first internally-cooled liner, the second internally-cooled liner extending around the quench zone in the elongated vessel, and the isolator is a third internally-cooled liner.

16. The entrained-flow gasifier reactor as recited in claim 15, wherein the first internally-cooled liner, the second internally-cooled liner and the third internally-cooled liner are on separate cooling circuits.

17. The entrained-flow gasifier reactor as recited in claim 12, wherein the elongated vessel includes vessel outlets at and near the bottom end discharging slag and product gas, respectively.

18. A method for managing molten slag in an entrained-flow gasifier reactor, the method comprising:

introducing reactants into a reaction zone enclosed by a first liner within a vessel, the reactants reacting and producing a gaseous reaction product and molten slag;

removing the molten slag from the reaction zone by allowing the molten slag to flow off of a drip lip and free fall through a cooled quench zone and into a slag collector, the cooled quench zone being at a lower temperature than the reaction zone; and thermally isolating the drip lip from the cooled quench zone such that that the molten slag at the drip lip remains molten; and injecting a gas curtain around the drip lip to limit deposit of molten slag as it free falls from the drip lip, wherein a gas flow of the gas curtain flows through a gap between the vessel and the first liner and into a radial gap between the isolator and the first liner.

19. The method as recited in claim 18, wherein at least one of the reactants comprises solid carbonaceous material.

20. The method as recited in claim 19, further comprising maintaining the environment around the drip lip at a temperature of greater than 1500° F. (815° C.).

21. The method as recited in claim 18, wherein the thermal isolating of the drip lip includes using an internally-cooled liner arranged around the drip lip.

* * * * *